US005782015A

United States Patent [19]

Dananberg

[11] Patent Number: 5,782,015

[45] Date of Patent: Jul. 21, 1998

[54] COMFORTABLE HIGH HEEL SHOE

[76] Inventor: Howard J. Dananberg, 19 Beaver La., Bedford, N.H. 03110

[21] Appl. No.: 720,719

[22] Filed: Oct. 2, 1996

Related U.S. Application Data

[63] Continuation-in-part of Ser. No. 303,872, Sep. 9, 1994, abandoned, which is a continuation of Ser. No. 60,700, May 12, 1993, abandoned, which is a continuation of Ser. No. 794,817, Nov. 18, 1991, abandoned, which is a continuation of Ser. No. 559,518, Jul. 23, 1990, abandoned, which is a continuation of Ser. No. 300,480, Jan. 23, 1989, abandoned, which is a continuation-in-part of Ser. No. 146,338, Jan. 21, 1988, abandoned.

[51] Int. Cl.[6] ..... A43B 21/26; A43B 21/00

[52] U.S. Cl. ..... 36/34 R; 36/35 R

[58] Field of Search ..... 36/34 R, 35 R, 36/25 R, 34 A, 34 B, 103

[56] References Cited

U.S. PATENT DOCUMENTS 2,088,263 7/1937 Grouven ..... 36/34 R X 2,648,916 8/1953 Greissinger ..... 36/34 R X 2,767,489 10/1956 Sturman ..... 36/34 R

*Primary Examiner*—B. Dayoan

*Attorney, Agent, or Firm*—Hayes, Soloway, Hennessey, Grossman & Hage, P.C.

[57] ABSTRACT

A high-heel shoe design applicable to varying heel heights, having a heel seat having a substantially neutral or slightly downwardly inclined angle (relative to the shank plane), and an arch support extending forward from the heel seat and having a first portion which supports the head of the navicular of the wearer in approximately the same plane (relative to the shank plane) as the wearer's heel bones. The shoe also includes a shank extending downwardly and forwardly from the first portion of the arch support, and a toe support region which extends at an inclination upwardly and forwardly from the shank whereupon the first metatarsal of the wearer is buttressed by the phalanges of the wearer to prevent forward sliding of the foot of the wearer relative to the shoe, thereby preventing jamming of the human digits into the toe portion of the shoe, while an increase of about 16% or more of the wearer's weight is borne by the heel seat, as compared to standard high heel dress shoes.

9 Claims, 7 Drawing Sheets

COMFORTABLE HIGH HEEL SHOE

This is a continuation-in-part of my application Ser. No. 08/303,872, filed Sep. 9, 1994 (now abandoned), which is, in turn, a File Wrapper Continuation of application Ser. No. 08/060,700 filed May 12, 1993 (now abandoned) which is a File Wrapper Continuation of application Ser. No. 07/794,817 filed Nov. 18, 1991 (now abandoned), which is a File Wrapper Continuation of application Ser. No. 07/559,518 filed Jul. 23, 1990 (now abandoned), which is a File Wrapper Continuation of application Ser. No. 07/300,480 filed Jan. 23, 1989 (now abandoned) which is a continuation-in-part of application Ser. No. 07/146,338 filed Jan. 21, 1988 (now abandoned).

BACKGROUND OF THE INVENTION

1. Field of the Invention

This invention relates to a new and improved design for high heel shoes.

2. Background of the Invention

Prior art high heel shoes in current use have a reputation of being extremely uncomfortable and there is survey information indicating that as many as 20% of the users of such shoes experience foot pain related to the shoes immediately and the majority of users experience such pain after as little as four hours of use. This discomfort results primarily from the wearer's foot sliding forwards in the shoe with the consequence that the wearer's toes are jammed in the toe portion of the shoe.

With reference to FIG. 1 there is shown in ghost the bone structure of a foot in a conventional high heel shoe. The foot structure comprises the heel bones 10 (also known as tarsus), including the talus and calcaneous, the arch including the cuneiform 11 and the metatarsus 12, and the toe bones or phalanges 13. The heel bones 10 are supported by the heel seat 19, while the arch extends over the shank region 15 of the shoe to the ball of the foot 16 where the metatarsus joins the base of the phalanges 13. The ball of the foot underlying the heads of the metatarsals, forming the metatarsus, and the phalanges are supported by the toe region 19 of the shoe.

The shoe illustrated in FIG. 1 has a heel height of approximately 2 inches. The particular shoe illustrated is based on a U.S. standard ladies' shoe size 7. The shoe is shown on to ground plane 18 from which the heel height "α" to the heel seat 19 is measured. The heel seat is inclined upwardly at an angle of approximately 12–15 degrees relative to the ground plane. This angle is referenced "x" in FIGS. 1 and 3. The shank 15 is angled downwardly and forwardly of the shoe from the heel seat at an angle of approximately 30 degrees relative to the ground plane. This angle is referenced "y" in FIGS. 1 and 3. In the toe region of the shoe the great toe is essentially parallel to the ground plane, but may be inclined upwardly and forwardly by the upward and forward inclination of the toe region at an angle of 2–3 degrees relatively to the ground plane 18. This angle is referenced "z" in FIGS. 1 and 3.

As will be appreciated, a conventional high heel shoe such as shown in FIG. 1 places the wearer's foot essentially on an inclined plane, whereupon the foot is urged forward into the toe box in standing or walking. This results in pressure on the ball or forefoot regions and toe jamming which often gives rise to a burning sensation in these areas of the foot, as well as fatigue and discomfort.

In order to alleviate some of the discomfort problems inherent in high heel shoes, one manufacturer has introduced a line of "comfortable" high heel shoes which include a cushioned sock liner.

Shoe insert pads also have been used to alleviate some of the discomfort problems associated with high heel shoes. The pads are either of the whole foot variety or designed for localized pressure areas of the foot, and are generally of a flexible cushioning material of some sort, e.g. foam.

Full foot pads shaped to conform to the contour of the shoe and thus cushion the entire foot area also have been suggested. Pads of this type are described, for example in U.S. Pat. No. 1,084,264 of French and U.S. Pat. No. 897,920 of McIntyre.

In addition to pads or insoles designed simply to cushion the foot for the comfort of the shoe wearer, some shoe insert pads are specially designed to correct or improve walking or posture of the shoe wearer. In U.S. Pat. No. 4,408,402 of Looney, for example, a supportive shoe insert pad is designed to fit the sole of a shoe to provide increased support during pregnancy, by providing specific increased support areas, i.e. of greater rigidity under the arch, and including areas of moderate flexibility and support in heel and under the respective ball areas extending from the big and little toes of the wearer. In U.S. Pat. No. 4,317,293 of Sigle et al, an insole pad is cut back behind the big toe area to reduce the rolling of a person's foot towards the outside.

Other shoe insert pads are known which are not shaped to conform to the contour of a shoe, but which are designed to be applied to specific areas of a shoe sole for various purposes. For example, in U.S. Pat. No. 3,316,663 of Neu, a pad which is arched upwardly towards its forward end is designed to fit below the ball of a person's foot to prevent the foot from sliding forward in a shoe. In U.S. Pat. No. 3,265,071 of Kirchner, a cushioning pad is designed to be fitted below the arch of a foot. In U.S. Pat. No. 2,482,333 of Everston, a heel-less substantially flat pad of multi-layer construction is described, which may be used to add apparent height to the wearer of a shoe. U.S. Pat. No. 2,862,313 of Jones describes insoles having apertures for the insertion of various resilient pads to support the metatarsal regions of a person's foot. Finally, U.S. Pat. No. 1,976,441 of Feldman describes a cushion foot and arch support which extends from the heel region to a line just before the toe region of a foot.

Full foot shoe insert pads tend to creep or slid down in the toe of the shoe and/or bunch up under the heel and arch, causing discomfort to the wearer of the shoe. This is true of any insert pad which raises the heel within the shoe, since the heel is the region of most slippage of a foot in a shoe.

Another attempt at reducing the discomfort resulting from the wearing of high heel shoes is found in U.S. Pat. No. 2,465,817 in which, in the toe portion of the shoe, a concave depression 22 is arranged to receive the ball portion of the wearer's foot and a convex mound portion 24 is provided forward of that concave portion whereby the weight of the wearer is supported mainly, if not entirely, by the ball portion of the foot and by the heel of the foot with the wearer's weight mainly on the ball portion of the foot. Such an arrangement is said to permit very high heels, as high as four inches, without discomfort to the wearer as the ball portion of the foot is received in the concave depression of the shoe thereby preventing the foot from sliding forward in the shoe. However, the heel seat proposed in the '817 patent is at a very substantial angle to the ground plane, i.e. in the order of 45 degrees. As a consequence, very little of the wearer's weight actually is supported by the heel seat; thus essentially all of the wearer's weight is carried mainly on the ball portion of the foot. This results in excessive weight being borne by the metatarsal with the likelihood that there will be excessive pressure on the head of the metatarsal which could result in metartarsalagia. Thus, this patented design results in substantial discomfort and a reduction in foot flexibility.

Other examples of prior art will be found in U.S. Pat. Nos. 1,693,398, 2,254,353, 2,370,789, 2,641,066, 2,852,865, 4,631,841 and U.S. RE Pat. No. 18,237.

It is an object of the present invention to provide a comfortable high-heel pump or fashion shoe which overcomes the aforesaid and other disadvantages of the prior art, and which is capable of being used for extended periods without discomfort.

SUMMARY OF THE INVENTION

According to the invention, there is provided a high-heel shoe having a heel seat having a slightly downwardly inclined angle (relative to the shank plane), and an arch support extending forward from the heel seat and having a first portion which supports the head of the navicular of the wearer. The shoe also includes a shank extending downwardly and forwardly from the first portion of the arch support, and a toe support region which extends at an inclination upwardly and forwardly from the shank whereupon the first metatarsal of the wearer is buttressed by the phalanges of the wearer to prevent forward sliding of the foot of the wearer relative to the shoe, thereby preventing jamming of the human digits into the toe portion of the shoe, while an increase of about 16% or more of the wearer's weight is borne by the heel seat, as compared to standard high heel dress shoes.

BRIEF DESCRIPTION OF THE DRAWINGS

The invention will now be described, by way of example, with reference to the accompanying drawings, in which like numbers depict like parts, and wherein.

DETAILED DESCRIPTION OF THE INVENTION

Figure 1:
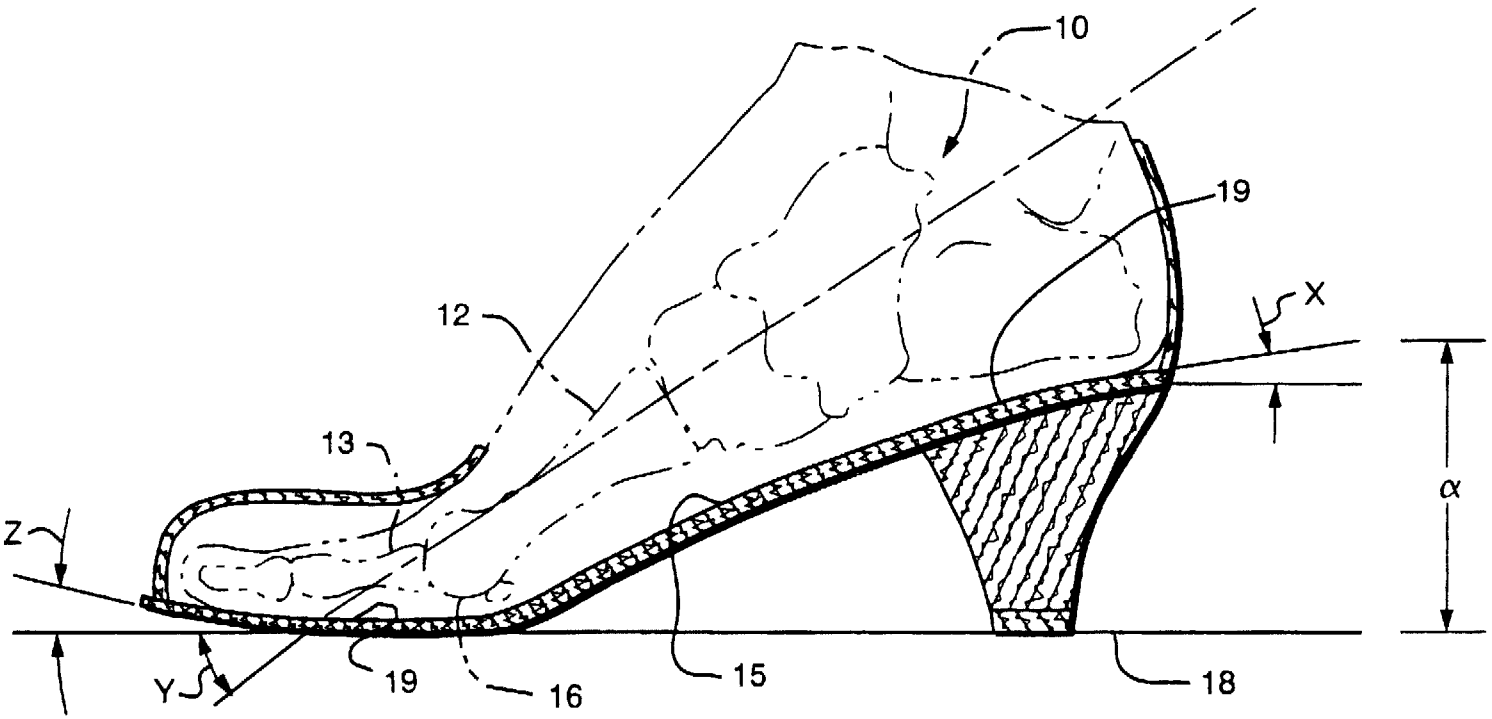
FIG. 1 (PRIOR ART)
FIG. 1 is diagrammatic cross sectional view of a conventional high heel shoe made in accordance with the prior art.
Figure 2:
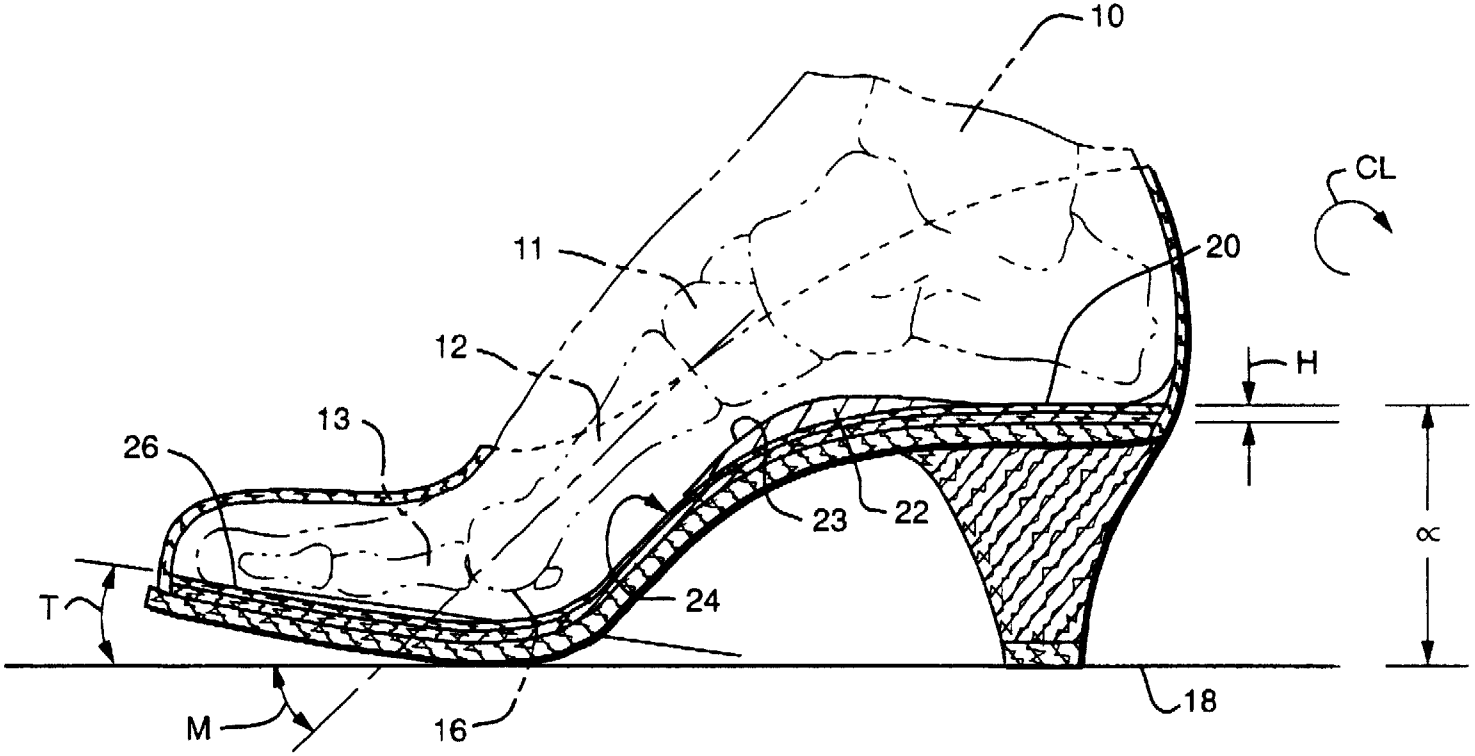
FIG. 2 is a diagrammatic cross sectional view of a high heel shoe made in accordance with the present invention.

Referring to FIG. 2, there is shown a preferred embodiment of the present invention. As in the case of the shoe of FIG. 1, the shoe shown in FIG. 2 has a heel height of approximately two inches. However, unlike the conventional shoe shown in FIG. 1, in the FIG. 2 shoe, the heel seat 20 is rotated clockwise, i.e., in the direction of arrow CL, relative to the shank plane at an angle "H", relative to ground plane, in accordance with the following formula:

$$H=5°+(\alpha\times1.25°)$$

where $\alpha$=the heel height in nearest ½" segments in excess of 1".

An arch support 22 extends forward from the forward edge of the heel seat 20 to underlie the arch of the foot of the wearer, at least in part. Arch support 22 has a contour with a high point 23 which forms a barrier which prevents forward sliding of the calcaneus of the wearer forward in the shoe. The arch support 22 then curves downwardly from the high point 23 to join the shank 24 which then runs to the toe region 26 of the shoe.

Shank 24 is inclined at an angle "M" perpendicular to the ground plane in accordance with the following formula:

$$M=18°+(\alpha\times3.5°)$$

where $\alpha$=the heel height in nearest ½" segments in excess of 1".

Maintaining the aforesaid relationships of "M" and "H" relative to heel height is critical to the present invention in order to prevent excessive height at point 23 which would be uncomfortable to the wearer. Thus, altering the M/H relationship as heel height $\alpha$ increases, results in a shift of the weight of the wearer onto the heel seat, thus preventing forwarding sliding in the shoe, but without creating a painful stress point under the arch of the wearer.

The toe region of the shoe is inclined upwardly and forwardly by the upward and forward inclination at an angle "T" of approximately 2°–3° plus/minus 1° relative to the ground plane.

The combination of the downward inclination of the heel seat, the contour of the arch support 22 as an extension of the heel seat, the incline of the shank, and the upward inclination of the toe region of the shoe, i.e. in accordance with the present invention, results in higher percentage of the weight of the wearer being carried by and supported by the heel seat than in the case of a conventional high heel shoe. Pressure measurements taken within the shoe under the wearer's heel seat and balls of the foot, respectively, of a high heel shoe made in accordance with the present invention, and a conventional high heel shoe of equal heel height, show a shoe made in accordance with the present invention provides an increase in the weight carried by the wearer's heel of approximately 16–18%, with a corresponding decrease in the weight carried by the ball of the foot of the wearer, during walking. Thus, as a consequence of a design of the shoe of the present invention, a greater portion of the weight of the wearer is borne by the heel seat rather than being transferred by the sloping shank of the shoe to the ball of the foot, toe jamming is prevented, and comfort assured.

Figure 3:
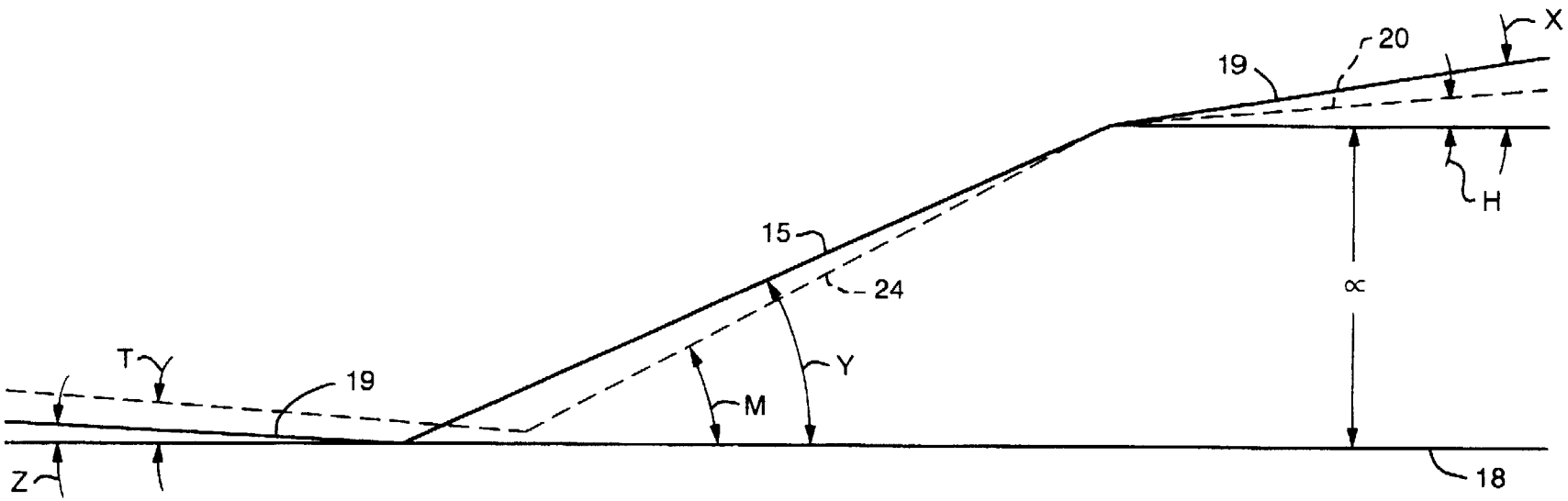
FIG. 3 is a diagrammatic representation showing a comparison of relevant angles to the ground plane of a shoe made according to the present invention such as that shown in FIG. 2, and a conventional high heel shoe having similar heel heights, i.e. such as shown in FIG. 1.
Figure 4:
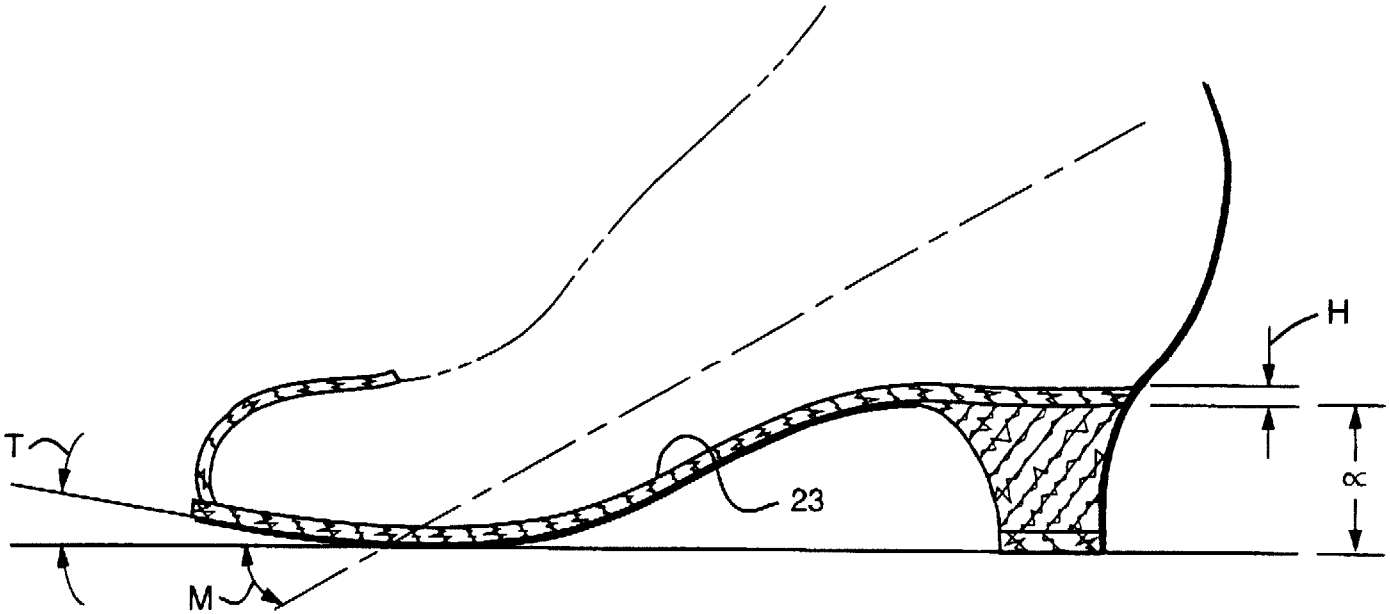
FIGS. 4–7 are views, similar to FIG. 2, of high heel shoes made in accordance with the present invention, and illustrating the application of the invention to shoes with varying heel heights.
Figure 5:
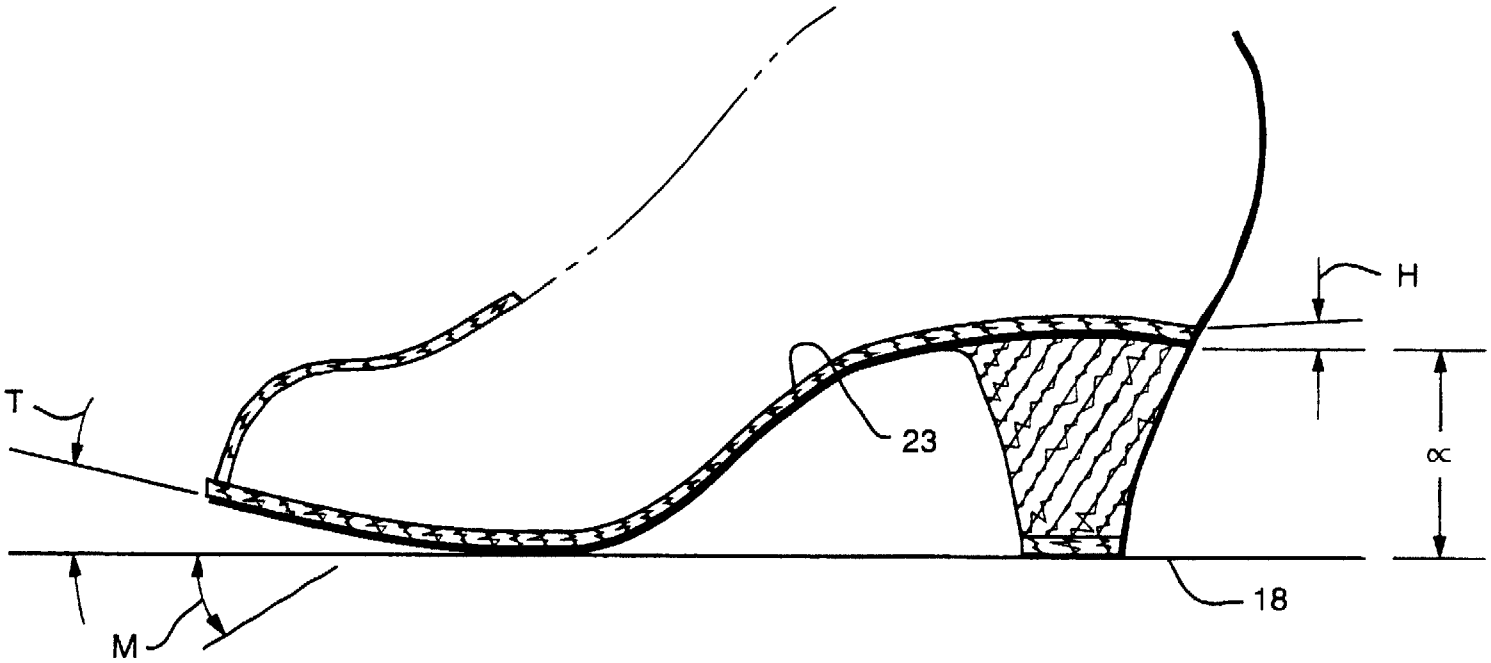
Figure 6:
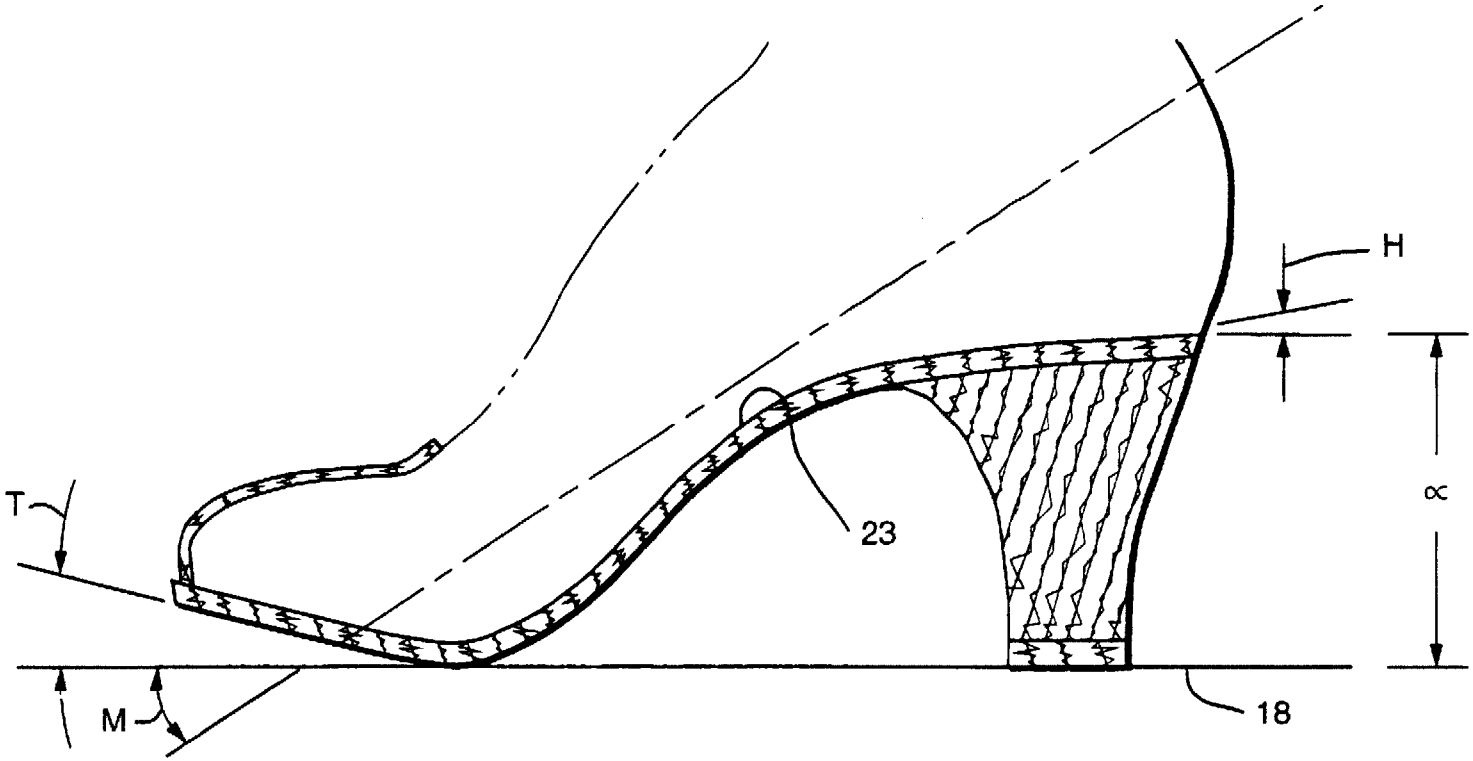

Referring to FIG. 3 the line in ghost illustrates the heel seat 20 angle H, the inclination M of the first metatarsal and of the great toe T in the toe region relative to the ground plane 18 of a high heel shoe made in accordance with the present invention. Dimension $\alpha$ represents the heel height. The solid line in FIG. 3 represents the corresponding set of angles and inclination for currently available high heel shoes having similar heel heights such as shown in FIG. 1 to that of the present invention. In these current shoes the inclination of the heel seat is upward towards the rear of the shoe at an angle x of approximately 8 degrees, the inclination of the first metatarsal downwardly and forward is at an angle y of about 27 degrees and the great toe is inclined upwardly and forwardly at an angle z of approximately 1½ degrees. These angles are also relative to the ground plane 18, and relate to a shoe of similar size.

A brief explanation of the mechanics of the foot may be helpful to facilitate an understanding of the function of the shoe of the present invention. The foot is capable of functioning in two separate mechanical fashions so as to support the body above. Primarily, the foot functions as a beam and supports the body by bending strain. This mechanism of support is effective when the force in acting on the arch (arch flattening force) is relatively low. This occurs at such times in the step when the center of body weight falls posterior (behind) the ankle joint. As the center of weight passes ahead of the ankle joint, as occurs in a normal step forward, the forces present begin to cause arch flattening. To counter this, the foot initiates a basic change in the mechanism of support to a truss form of support and is then capable of supporting via compression strain. Since the bones of the foot have been shown to be extremely strong in terms of compression strength, the greater the compression strain, the better the arch support ability. In order for the foot to achieve this change in support mechanism, the metatarsals must be buttressed by the bending of the toes. This buttress effect prevents the metatarsals from sliding forward and thus permits the switch from bending to compression support.

It is the combination of this effect and the shape and inclination of the heel seat and arch support in the shoe design of the present invention that provides the advantages of the present invention. By creating a particular platform surface for the foot, a buttress effect is initiated in a more effective fashion preventing the forward sliding of the metatarsal bones and, as a result, eliminating the subsequent jamming of the toes into the pointed front of the shoes.

Increasing the angle of bending, dorsiflexion of the toes in the shoes can be accomplished in one of two ways. The tip of the shoes may be lifted upwards creating a "genie" type shoe. Although this would be effective, it would not be particularly stylish. A more effective mechanism entails increasing the angle at which the metatarsals themselves approach the sole of the shoe. This has the effect of increasing the bending of the toes without creating a "genie" type shoe. This increase in the angle of the metatarsals relative to the ground plane is accomplished by the change in the rear construction of the shoe, specifically the angle of the heel seat 14, and by extending the arch support under the navicular of the wearer as previously discussed. Since the foot is jointed in a variety of locations, the plane that the heel bone (calcaneus) takes with the ground will be compensated for by the pitch of the metatarsals as they approach the ball of the foot. This angular relationship is inversely proportional. The closer the calcaneous comes to parallel with the ground (provided there is adequate heel height present), the closer the metatarsals approach a perpendicular attitude. Thus, by providing a heel seat with a low slope to increase the descent angle of the metatarsal, the desired buttressing effect is achieved.

In the present invention, the heel seat is maintained downwardly inclined with respect to the shank irrespective of the heel height, and the navicular of the wearer is supported by an arch support extending forward from the heel seat. In prior art shoe designs, the higher the heel of the shoe, the closer the heel seat angle approaches the shank angle. This relative relationship in prior art shoe designs created an inclined platform of the foot toward the floor. This increased angle in turn forced the foot to slide forward and be pinched in the toe portion of the shoes. The present invention creates a shoe in which the heel seat is downwardly inclined relative to the shank regardless of heel height, and provides an arch support which underlies and supports the navicular of the wearer, thereby creating a surface which causes a greater percentage of the wearer's weight is carried by the heel seat. The metatarsal angle (corresponding to the shank of the shoe) increases proportionally to the heel height, e.g. the higher the heel, the greater the metatarsal angle to the floor. In a shoe with a heel height over 2 inches, the advantage is not of increased metatarsal inclination, but rather the resulting biomechanical change in metatarsal inclination due to the maintenance of heel seat more closely aligned to parallel to the ground plane.

This effect is emphasized when the toe region is angled as specified above in order to increase the spring angle of the toes. As a consequence of this particular design, the load distribution between the foot and the shoe is effected whereby when the wearer is at rest a greater proportion of the weight of the wearer is borne by the heel seat rather than being transferred by the sloping surface of the prior art shoes to the ball of the foot with consequent problems as referred to above. Thus, with the design of the present invention, toe jamming is prevented and comfort assured.

Figure 7:
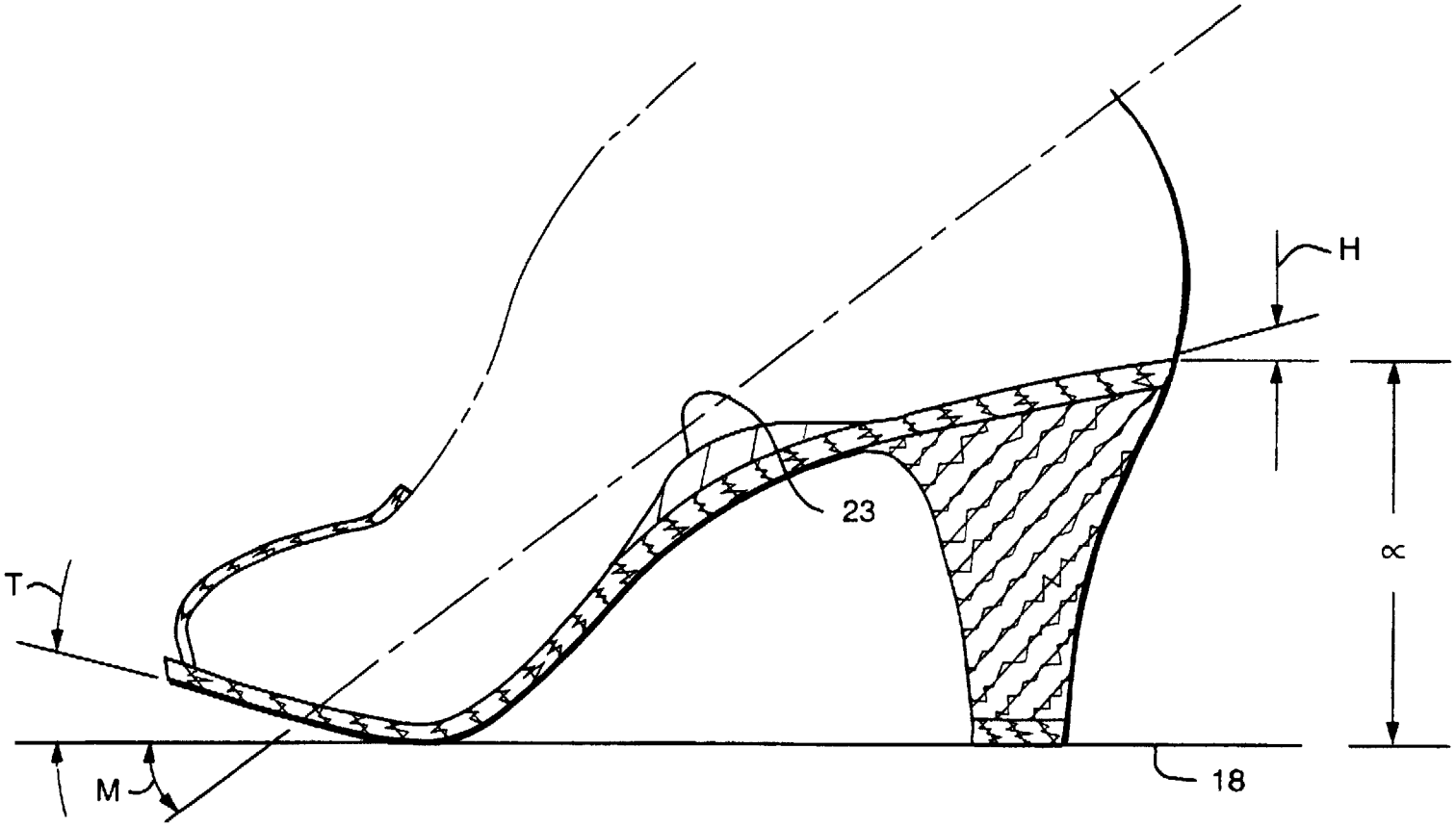

While the description above has been made with respect to a U.S. standard ladies' shoe size 7, having a 2 inch heel height, the invention is specifically designed to be applicable to the whole usual range of U.S. standard ladies' shoe sizes and particularly to those in the range having from size 5 to size 10, and having various heel heights and particularly to those heel heights that range from 1 to 3 inches. With different shoe sizes and heel heights, the metatarsal inclination will vary within the range of about 18–22 degrees in the case of a 1 inch heel height to about 33–36 degrees in the case of a 3 inch heel height. FIGS. 2 and 4–7 and the following Table I illustrate high heel shoes made in accordance with the present invention, and having heel heights of 1 inch (FIG. 4), 1½ inches (FIG. 5), 2 inches (FIG. 2), 2½ inches (FIG. 6), and 3 inches (FIG. 7.)

TABLE I

| Heel Height (∝) | Heel Seat Inclination (H) | Metatarsal Angle (M) | Toe Angle (T) |
|---|---|---|---|
| 1" | 5–6% | 18–22% | 1–2% |
| 1½· | 6–7% | 20–23% | 2–3% |
| 2" | 7–8% | 24–28% | 2–3% |
| 2½· | 8–9% | 30–33% | 2–3% |
| 3" | 9–10% | 33–36% | 3–4% |

Yet other changes may be made in the present invention without departing from the spirit and scope thereof.

I claim:

1. A high heel shoe having a fixed heel height α of at least one inch, a heel seat topping said heel, an arch support extending forward from the heel seat and having a first portion which supports the head of the navicular of the wearer in approximately the same plane (relative to the ground plane) as the wearer's heel bones, a shank extending downwardly and forwardly from the first portion of the arch support, and a toe support region which extends at an inclination upwardly and forwardly from the shank whereby to buttress the phalanges of the wearer to prevent forward sliding of the foot of the wearer relative to the shoe, wherein the heel seat is situated clockwise relative to the shank at an angle "H" which is relative to the ground plane in accordance with the following formula:

$$H=5°+(\alpha\times1.25°)$$

wherein α=the heel height in nearest ½ inch segments in excess of 1", and the shank is inclined at an angle M perpendicular to the ground plane in accordance with the following formula:

$$M=18°+(\alpha\times3.25°)$$

wherein α=the heel height in nearest ½ inch segments in excess of 1".

2. A high heel shoe according to claim 1, wherein the heel seat is inclined with respect to the ground plane at an angle of approximately 3° plus/minus 1°.

3. A high heel shoe according to claim 1, wherein said shank is inclined relative to the ground plane at an angle of approximately 3° plus/minus 3°.

4. A high heel shoe according to claim 1, wherein the toe region of the shoe is inclined at an angle of approximately 2°–3° plus/minus 1° with respect to the ground plane.

5. A high heel shoe according to claim 1, wherein said heel height α is approximately 1", said heel seat inclination H is 5°–6°, said metatarsal angle M is 18°–22° and said toe angle T is 1°–2°.

6. A high heel shoe according to claim 1, wherein said heel height α is approximately 1½", said heel seat inclination H is 6°–7°, said metatarsal angle M is 20°–23° and said toe angle T is 2°–3°.

7. A high heel shoe according to claim 1, wherein said heel height α is approximately 2", said heel seat inclination H is 7°–8°, said metatarsal angle M is 24°–28° and said toe angle T is 2°–3°.

8. A high heel shoe according to claim 1, wherein said heel height α is approximately 2½", said heel seat inclination H is 8°–9°, said metatarsal angle M is 30°–33° and said toe angle T is 2°–3°.

9. A high heel shoe according to claim 1, wherein said heel height α is approximately 3", said heel seat inclination H is 9°–10°, said metatarsal angle M is 33°–36° and said toe angle T is 3°–4°.

* * * * *

UNITED STATES PATENT AND TRADEMARK OFFICE

CERTIFICATE OF CORRECTION

PATENT NO. : 5,782,015

DATED : July 21, 1998

INVENTOR(S) : Howard D. Dananberg

It is certified that error appears in the above-identified patent and that said Letters Patent is hereby corrected as shown below:

Col. 6, lines 36-40 , change the percent sign "%" to a degree sign - - ° - - all fifteen occurrences.

Signed and Sealed this

Eleventh Day of January, 2000

*Attest:*

Q. TODD DICKINSON

*Attesting Officer*

*Acting Commissioner of Patents and Trademarks*